US006662740B1

(12) United States Patent
Noe et al.

(10) Patent No.: US 6,662,740 B1
(45) Date of Patent: Dec. 16, 2003

(54) ADJUSTABLE BOAT WHIP ASSEMBLY

(76) Inventors: Forrest Edward Noe, HC73, Box 287A, Alton Bay, NH (US) 03810; Keith Forrest Noe, 1 N. Hereford Dr., Cumberland, RI (US) 02864

( * ) Notice: Subject to any disclaimer, the term of this patent is extended or adjusted under 35 U.S.C. 154(b) by 0 days.

(21) Appl. No.: 10/246,349

(22) Filed: Sep. 18, 2002

(51) Int. Cl.[7] ..... B63B 21/00
(52) U.S. Cl. ..... 114/230.11
(58) Field of Search ..... 114/218, 230.1, 114/230.11, 230.15, 230.16, 230.17, 230.18, 230.19

(56) References Cited

U.S. PATENT DOCUMENTS 2,771,053 A * 11/1956 Gustafson ..... 114/230.19
3,196,824 A * 7/1965 Howard ..... 114/230.19
3,636,908 A * 1/1972 Feldman et al. ..... 114/230.15
4,040,377 A 8/1977 Olsen
4,250,827 A * 2/1981 Booker et al. ..... 114/230.18
4,356,783 A 11/1982 Myklebust et al.
4,992,015 A * 2/1991 Florence ..... 410/104
5,036,784 A 8/1991 Wagner
5,154,132 A 10/1992 Brushaber
5,282,434 A * 2/1994 Hart et al. ..... 114/230.16
5,361,716 A 11/1994 Cotton
5,494,327 A 2/1996 Derecktor
5,575,234 A 11/1996 Dysarz

* cited by examiner

*Primary Examiner*—S. Joseph Morano
*Assistant Examiner*—Andrew Wright

(57) ABSTRACT

An adjustable boat whip assembly for maintaining a boat in spaced relation to a dock includes a boat whip, an elongate base member secured to the dock, a whip support member having a receptacle for receiving the boat whip in a generally upright position, and an interconnecting structure for attaching the support member to the base member so that the support member can move along the length of the base member. A fastener is further provided for locking the support member to the base member. In one embodiment of the invention, the base member of the boat whip assembly includes a structural tubular body having an upwardly extending top flange that is received in a slot provided in the support member. The arrangement is such that the support member is movable along the length of the base member.

15 Claims, 4 Drawing Sheets

ADJUSTABLE BOAT WHIP ASSEMBLY

BACKGROUND OF THE INVENTION

This invention relates generally to devices used to maintain a boat in spaced relation from a dock, such devices being known in the art as boat whips, and more particularly to a boat whip assembly that is longitudinally adjustable along the length of the dock to accommodate boats having varying lengths.

Boat whips are well known in the art. FIG. 1 illustrates the use of a conventional boat whip 10. As shown, a boat 12 is tied to a dock 14 by means of a pair of ropes, each indicated at 16. Each rope 16 is attached at one end thereof to a cleat 18, which is mounted on the boat 12, and at its other end to a vertically oriented post 20, which is secured in a suitable manner to the dock 14. It is understood that the boat 12 can be secured to the dock 14 in any number of ways, and that the manner illustrated in FIG. 1 is for illustration purposes only. For example, the boat can be secured to a cleat (not shown) mounted on the top surface of the dock or on the post.

Without boat whips 10, the boat 12 has a tendency to bang into the dock 14 and/or the posts 20 when waves move the boat 12 into and away from the dock 14. During especially rough conditions where the waves greatly effect the movement of the boat 12, such conditions can cause extreme damage to the boat 12 since nothing prevents the boat from engaging the dock. Prior to the introduction of boat whips, bumpers (not shown) were employed to protect the boat from banging into the dock.

Presently available boat whips 10 stand the boat 12 away from the dock 14, thereby preventing damage to the boat. More specifically, as illustrated in FIG. 2, the boat whip 10 comprises a base 22, which is secured to the dock 14 by any suitable means, including wood screws 24. The base includes an annular receptacle 26 for receiving a flexible (and typically cylindrical) rod 28, which has one end seated therein and an opposite end having a thin line or tether (not shown) attached thereto. This thin line is secured at its other end to the cleat 18 provided on the boat 12. The arrangement is such that the flexible rod 28, since it extends over the body of the boat 12, maintains the boat 12 in a spaced relation away from the dock 14, thereby allowing the boat to move slightly toward and away from the dock, but never in contact with the dock.

The boat whip 10 described above, while effective in achieving its intended purpose, i.e., maintaining the boat 12 away from the dock 14, does suffer from significant limitations. For example, when employing the boat whip 10, it must be secured on the dock 14 typically by means by the permanent fastener 24 in a position generally adjacent to the boat's cleats 18. It is very important that the spacing of the boat whips 10 be nearly identical to the spacing of the cleats 18 so that the boat whips 10 maximize their effect on the boat 12 by extending perpendicularly away from the dock 14 over the body of the boat.

One disadvantage of this arrangement is that boat whips 10 can only accommodate boats having identical or nearly identical spacing between cleats 18. Once permanently affixed to the dock 14, the boat whips 10 cannot be easily removed and reattached to accommodate boats having more or less spacing between the cleats 18. Thus, another boat tied to a dock having a cleat spacing different than the cleat spacing of the boat for which the boat whips were employed could not take advantage of the boat whips since they would not keep the boat away from the dock. There is presently a need in the art for an adjustable boat whip assembly that can accommodate boats having varying sizes, especially having varying distances between their cleats.

SUMMARY OF THE INVENTION

Accordingly, among the several objects of the present invention is the provision of an adjustable boat whip that can be easily adjusted to accommodate boats having varying spacing between cleats.

In general, an adjustable whip of the present invention for maintaining a boat in spaced relation to a dock comprises a boat whip, an elongate base member having means for mounting the base member on the dock, a whip support member having means for receiving the boat whip in a generally upright position, and interconnecting means for attaching the support member to the base member so that the support member can move along the length of the base member. Locking means is further provided for locking the support member to the base member.

In one embodiment of the invention, the base member of the boat whip assembly comprises a structural tubular body having an upwardly extending top flange that is received in a slot provided in the support member. The arrangement is such that the support member is movable along the length of the base member.

Other objects, features and advantages of the invention shall become apparent as the description thereof proceeds when considered in connection with the accompanying illustrative drawings.

BRIEF DESCRIPTION OF THE DRAWINGS

In the drawings, which illustrate the best mode presently contemplated for carrying out present invention.

Corresponding reference numerals designate corresponding parts throughout the several views of the drawings.

DETAILED DESCRIPTION OF THE PREFERRED EMBODIMENTS

Figure 1:
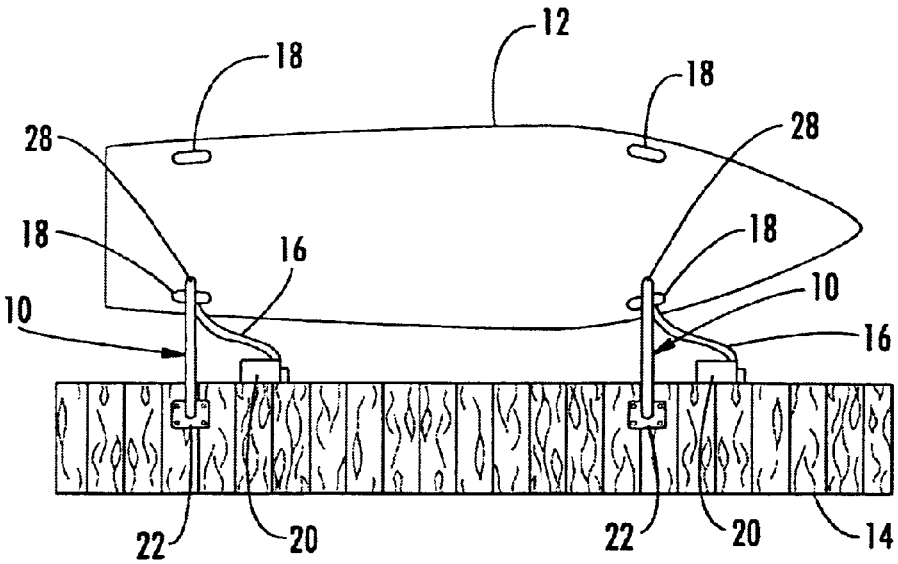
FIG. 1 (PRIOR ART)
FIG. 1 is a top plan view of a boat secured to a dock, and a prior art boat whip for maintaining the boat away from the dock.
Figure 2:
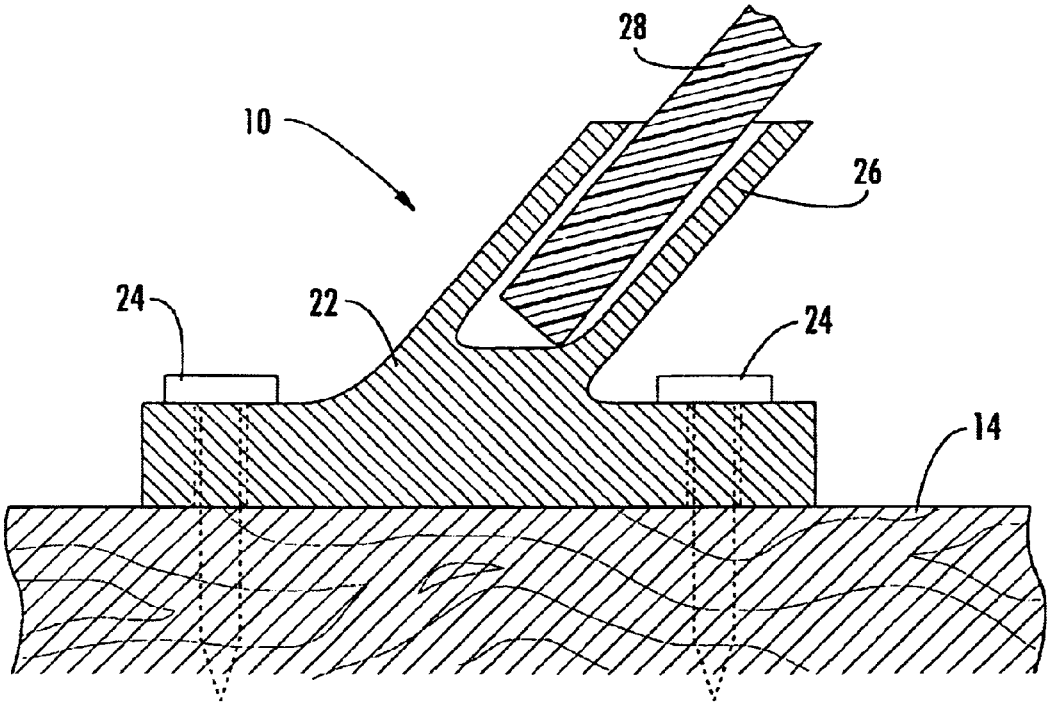
FIG. 2 (PRIOR ART)
FIG. 2 is a cross-sectional view of the prior art boat whip shown in FIG. 1.
Figure 3:
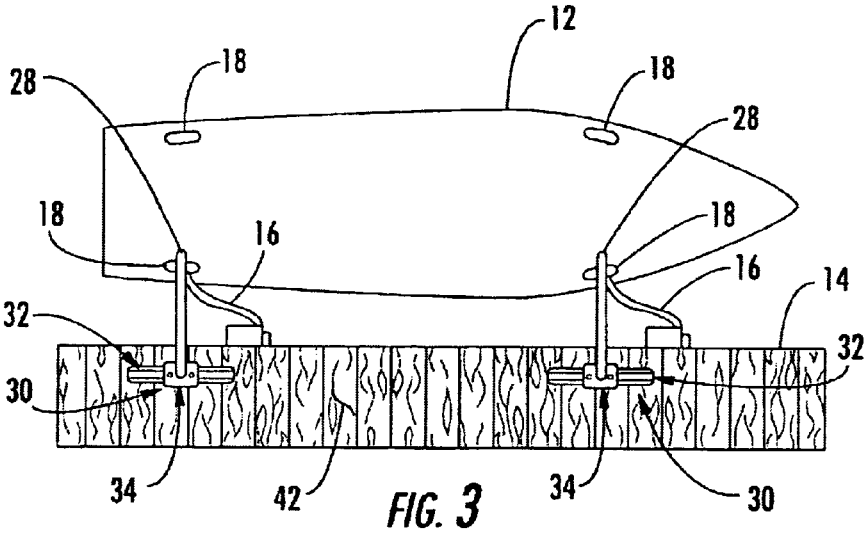
FIG. 3 is a top plan view similar to FIG. 1 illustrating an adjustable boat whip assembly of the present invention.

Referring now to the drawings, and more particularly to FIG. 3, adjustable two boat whip assemblies of the present invention are each generally indicated at 30. As shown, the boat 12 is secured to the posts 20 of the dock 14 in the manner set forth and illustrated in FIG. 1. Specifically, ropes 16 attach the cleats 18 of the boat 12 to the dock 14 in the conventional manner. It is understood that different arrangements for securing the boat 12 to the dock 14 are known in the art. For example, the ropes 16 could be secured to cleats (not shown) mounted on the dock 14. However, the boat whip assemblies 30 of the present invention are configured to accommodate boats having varying lengths between the cleats mounted on the boats. The primary advantage of this configuration is that different boats can be effectively secured to the dock without risk of the boats banging against the dock.

Figure 4:
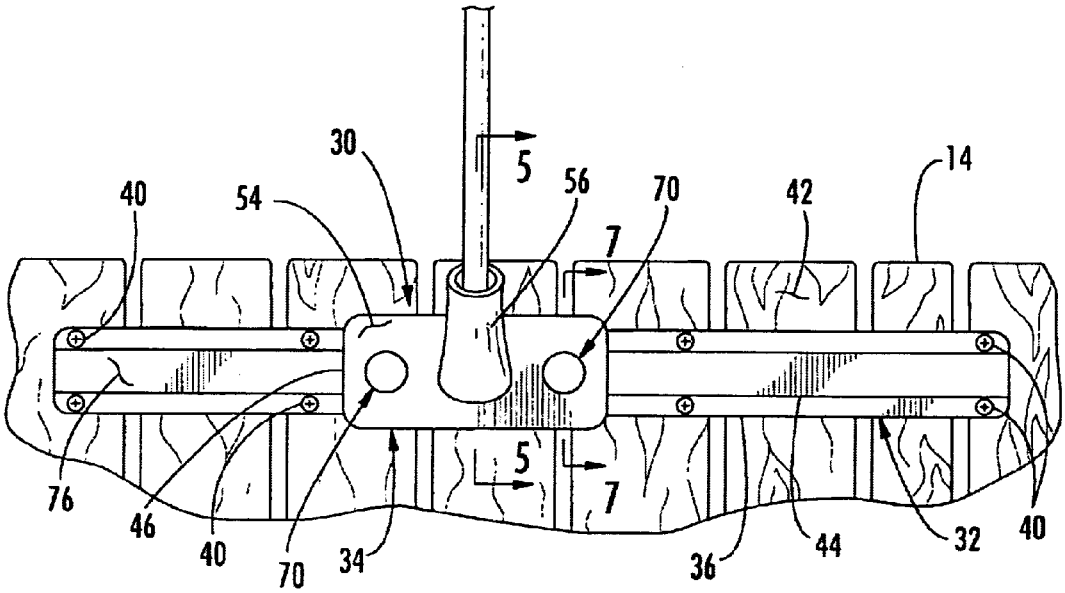
FIG. 4 is an enlarged top plan view of the boat whip shown in FIG. 3.
Figure 5:
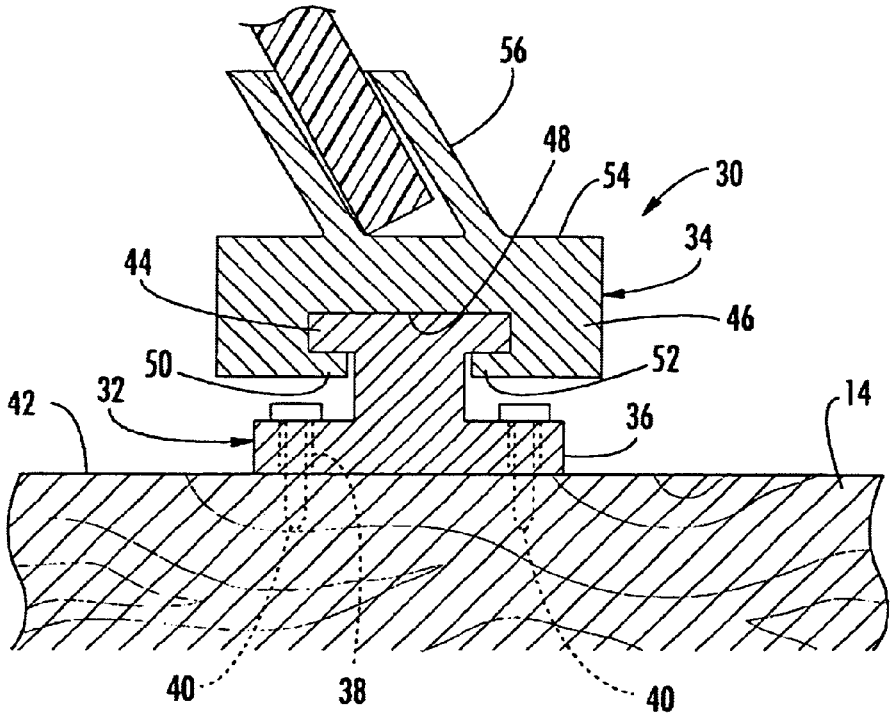
FIG. 5 is a cross-sectional view taken along line 5—5 in FIG. 4.

Turning now to FIGS. 3–5, each boat whip assembly 30 comprises an elongate base member, generally indicated at 32, and a whip support member, generally indicated at 34. Although two separate base members 32 are shown in FIG. 3, it is conceivable that only one base member need be provided to accommodate any number of whip support members, e.g., two or more. Additionally, although one whip support member 34 is shown with a base member 32, it is within the scope of the present invention to have two or more whip support members 34 per base member 32 to accommodate boats having more than two cleats.

The base member 32 comprises a bottom flange 36 having spaced-apart openings 38 provided therein for receiving permanent fasteners 40 (e.g., wood screws) for attaching the base member 32 to the dock 14. As illustrated in FIG. 3, the base member 32 is attached to the dock 14 in a direction parallel to the direction of the dock 14 adjacent to the side of the dock where the boat 12 is secured. Although the drawing figures illustrate the base member 32 mounted on a top surface 42 of the dock 14, it is contemplated, but not shown, that the base member 32 can be recessed within a channel formed in the dock. This arrangement would prevent boat operators and passengers from inadvertently stepping on or tripping on the base member.

Referring particularly to FIGS. 4 and 5, the base member 32 further comprises an upwardly extending male member or top flange 44 that is parallel to but shorter than the bottom flange 36. This arrangement renders the mounting of the permanent fasteners 40 more easily since the permanent fasteners 40 can be secured to the base member 32 and dock 14 with conventional tools, e.g., a screw driver or a socket wrench. Preferably, the base member 32 is fabricated from strong material, including, but not limited to, steel, aluminum, or an aluminum alloy, suitable for releasably securing the whip support member thereto in the manner illustrated in the drawings.

The whip support member 34 comprises a plate 46 of structurally strong material (also preferably fabricated from steel, aluminum, or an aluminum alloy) that is configured and arranged to move along the base member 32. Specifically, the whip support member 34 has a downwardly opening female member or slot 48 (FIG. 5) formed therein that is dimensioned to snugly receive the top flange 44 of the base member 32 therein. The interconnection of the whip support member 34 to the base member 32 is broadly referred to herein as an interconnecting means. The whip support member 34 is received over the end (not designated) of the base member 32 and movable along the length of the base member 32. As shown, the slot 48 is defined by a pair of inwardly extending fingers 50, 52 (see FIG. 5). Provided on a top surface 54 of the whip support member 34 is an upwardly extending, annularly shaped receptacle 56 for receiving the rod or whip 28 therein. As shown, the receptacle 56 is angled so that the whip 28 extends laterally away from the assembly 30 in a direction over the cleat 18 of the boat 12 generally perpendicular to the direction of the boat 12. The whip 28 is secured to the whip support member 34 within the receptacle 56 by any conventional means, such as a set screw (not shown).

It is understood that the whip 28 is of conventional construction, it being fabricated from any suitable flexible material, such as fiberglass or some other thermoplastic material well known in the art. The whip 28 has one end (not designated), as described above, that is suitably secured within the receptacle 56 and an opposite end (not designated) that has a thin line or tether (not shown), which is secured to the appropriate cleat 18 of the boat 12. This arrangement is well known in the art and does not require any further description herein. As will be described in more detail below, the whip support member 34 is movable along the base member 32 to accommodate boats having varying spacing between cleats.

Figure 6:
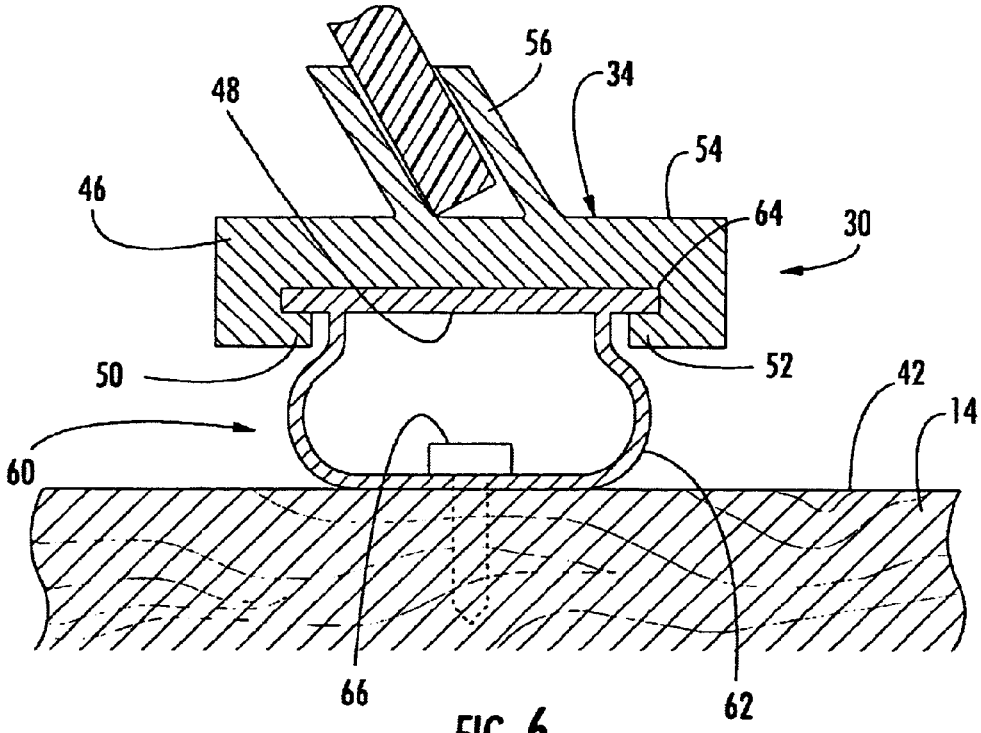
FIG. 6 is a cross-sectional view similar to FIG. 5 illustrating an adjustable boat whip assembly of another preferred embodiment.

Turning now to FIG. 6, there is illustrated a base member, generally designated at 60, of an alternate embodiment. Specifically, the base member 60 comprises a structural tubular body 62 having an upwardly extending male member or flange 64 (similar to flange 44) that is received in the slot 48 of the whip support member 34. The tubular body 62 is secured in place on the dock 14 by a suitable permanent fastener 66. The tubular body 62 provides greater structural support, and can be fabricated from any material that can be extruded, such as aluminum or an aluminum alloy.

Figure 7:
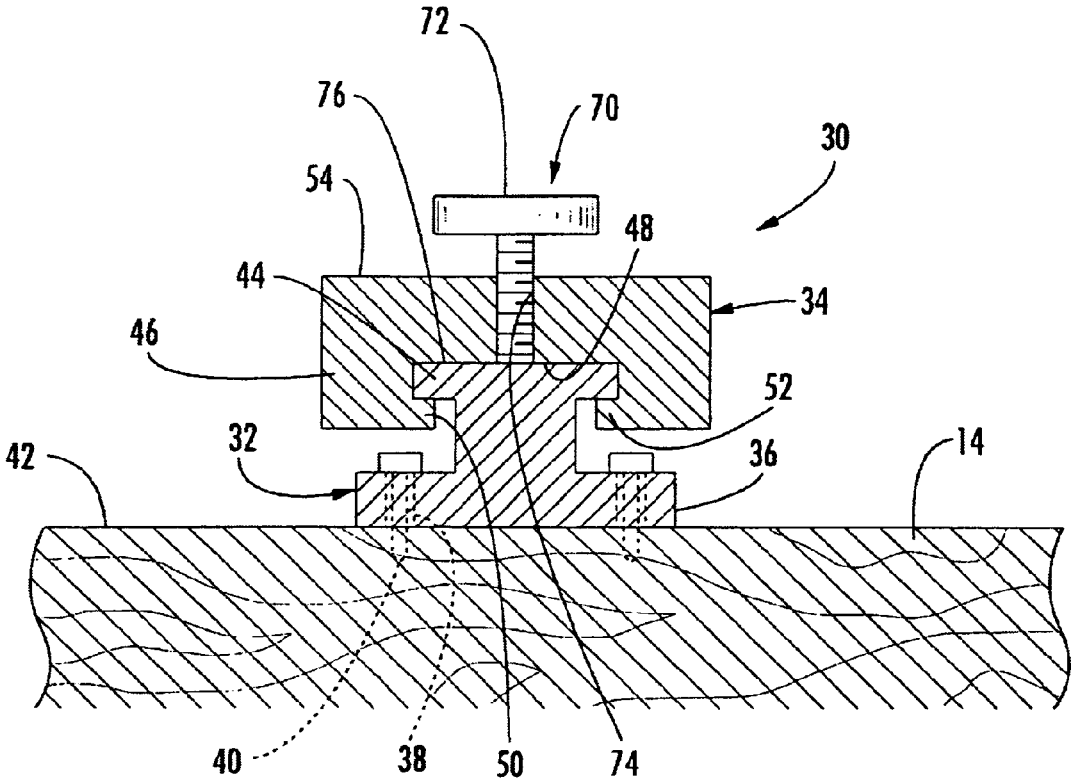
FIG. 7 is a cross-sectional view taken along line 7—7 in FIG. 4.

Turning now to FIG. 7, there is generally indicated at 70 a locking mechanism for releasably locking the whip support member 34 to the base member 32. The locking mechanism 70 comprises a threaded fastener 72 (e.g., a thumb screw) which is threadably engaged to the whip support member 34 within a threaded opening 74 provided therein. The arrangement is such that the threaded fastener 72, when tightened, engages a top surface 76 of the top flange 44 of the base member 32 for releasably locking the whip support member 34 to the base member 32. By simply loosening or untightening the threaded fastener 72, the whip support member 34 is unlocked, thereby allowing the whip support member 34 to move longitudinally along the length of the base member 32.

Thus, the boat whip assembly 30 is capable of moving the whip 28 by loosening the threaded fastener 72, adjusting the whip support member 34 to its appropriate location (e.g., adjacent the cleat 18 of the boat 12), and locking the threaded fastener 72 in place by tightening it. Accordingly, the system of the present invention can accommodate boats having varying distances between cleats, limited only by the length of the base member.

As mentioned above, several features not illustrated in the drawings include: the provision of one base member 32 or 60; the provision of more than two boat whip support members 34 movable along the base member 32 or 60; and the securing of the base member 32 or 60 within a recess provided within the dock 14.

While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An adjustable boat whip assembly for maintaining a boat in spaced relation to a dock, the boat whip assembly comprising:

a boat whip having a flexible rod with two opposite ends;

an elongate base member having means for mounting the base member on the dock;

a whip support member having means for receiving one end of the boat whip in a generally upright position so that the boat whip extends over the boat;

interconnecting means for attaching the support member to the base member so that the support member can move along the length of the base member; and locking means for locking the support member to the base member;

wherein the opposite end of the flexible rod has a thin line secured to the boat for maintaining the boat in spaced relation to the dock, the flexible rod allowing the boat to move toward and away from the dock.

2. The boat whip assembly set forth in claim 1, said interconnecting means comprising an upwardly extending top flange provided on the base member that is received in a slot provided in the whip support member, the arrangement being such that the support member is movable along the length of the base member.

3. The boat whip assembly set forth in claim 2, said locking means comprising a threaded fastener threadably engaged in a threaded opening provided in the support member, the arrangement being such that the threaded fastener, upon being tightened, engages the base member to lock the support member in place.

4. The boat whip assembly set forth in claim 1, said base member comprising a structural tubular body.

5. The boat whip assembly set forth in claim 4, said tubular body having an upwardly extending top flange that is received in a slot provided in the support member, the arrangement being such that the support member is movable along the length of the base member.

6. An adjustable boat whip assembly for maintaining a boat in spaced relation to a dock, the boat whip assembly comprising:

a boat whip having a flexible rod with two opposite ends;

an elongate base member having means for mounting the base member to the dock, said base member having an upwardly extending male top flange formed therein along the length of the base member;

a whip support member having an upwardly extending, annularly-shaped receptacle formed therein for receiving one end of the boat whip in a generally upright position so that the boat whip extends over the boat, and a downwardly opening, elongate slot that is constructed and arranged to receive the top flange of the base member therein, the arrangement being such that the support member is movable along the length of the base member; and a threaded fastener for locking the support member to the base member;

wherein the opposite end of the flexible rod has a thin line secured to the boat for maintaining the boat in spaced relation to the dock, the flexible rod allowing the boat to move toward and away from the dock.

7. The boat whip assembly set forth in claim 6, said base member comprising a structural tubular body.

8. An adjustable boat whip assembly for maintaining a boat in spaced relation to a dock, the boat whip assembly comprising:

a boat whip having a flexible rod with two opposite ends;

an elongate base member secured to the dock;

a whip support member movably attachable to the base member for supporting the boat whip in a generally upright position so that the boat whip extends over the boat, the support member being movable along the length of the base member for adjusting the position of the boat whip;

wherein the opposite end of the flexible rod has a thin line secured to the boat for maintaining the boat in spaced relation to the dock the flexible rod allowing the boat to move toward and away from the dock.

9. The boat whip assembly set forth in claim 8 further comprising locking means for locking the support member to the base member.

10. The boat whip assembly set forth in claim 8, said base member comprising a structural tubular body.

11. The boat whip assembly set forth in claim 10, said tubular body having an upwardly extending top flange that is received in a slot provided in the support member, the arrangement being such that the support member is movable along the length of the base member.

12. The boat whip assembly set forth in claim 8 further comprising interconnecting means for attaching the support member to the base member.

13. The boat whip assembly set forth in claim 12, said interconnecting means comprising an upwardly extending top flange provided on the base member that is received in a slot provided in the whip support member, the arrangement being such that the support member is movable along the length of the base member.

14. The boat whip assembly set forth in claim 13 further comprising locking means having a threaded fastener threadably engaged in a threaded opening provided in the support member, the arrangement being such that the threaded fastener, upon being tightened, engages the base member to lock the support member in place.

15. The boat whip assembly set forth in claim 14, said base member comprising a structural tubular body.

* * * * *